US012486075B2

(12) United States Patent
Vo

(10) Patent No.: US 12,486,075 B2
(45) Date of Patent: Dec. 2, 2025

(54) BOTTLE WITH INTEGRATED HANDLE AND DESIGN ELEMENT

(71) Applicant: Illinois Tool Works Inc., Glenview, IL (US)

(72) Inventor: Kimberly J. Vo, Glenview, IL (US)

(73) Assignee: Illinois Tool Works Inc., Glenview, IL (US)

( * ) Notice: Subject to any disclaimer, the term of this patent is extended or adjusted under 35 U.S.C. 154(b) by 217 days.

(21) Appl. No.: 18/073,976

(22) Filed: Dec. 2, 2022

(65) Prior Publication Data

US 2023/0174273 A1 Jun. 8, 2023

Related U.S. Application Data

(60) Provisional application No. 63/285,126, filed on Dec. 2, 2021.

(51) Int. Cl.
*B65D 23/10* (2006.01)
*B65D 1/02* (2006.01)
*B65D 23/00* (2006.01)

(52) U.S. Cl.
CPC ..... *B65D 23/102* (2013.01); *B65D 1/0246* (2013.01); *B65D 23/006* (2013.01); *B65D 2501/0036* (2013.01)

(58) Field of Classification Search
CPC ..... B65D 23/102; B65D 2501/0081; B65D 25/2811; B65D 1/0284; B65D 1/40; B65D 23/10; B65D 85/80; B65D 1/0223; B29L 2031/7158; B29C 49/087; B29C 49/48
USPC ..... 222/23
See application file for complete search history.

(56) References Cited

U.S. PATENT DOCUMENTS 3,225,950 A * 12/1965 Fulcher ..... B65D 1/0223 215/384
5,226,550 A * 7/1993 Mikolaitis ..... B65D 23/102 215/398
5,472,105 A * 12/1995 Krishnakumar ... B65D 79/0084 D9/557
6,212,953 B1 * 4/2001 Bethune ..... G01F 19/00 73/427
6,223,945 B1 5/2001 Giblin et al.
(Continued)

FOREIGN PATENT DOCUMENTS

WO 2008018908 A1 2/2008
WO 2011131920 A1 10/2011
WO 2021236322 A1 11/2021

OTHER PUBLICATIONS

Int'l Search Report for PCT/US2022/051836, dated Jul. 31, 2023.

*Primary Examiner* — Vishal Pancholi
(74) *Attorney, Agent, or Firm* — MaxGoLaw PLLC

(57) ABSTRACT

A thermoplastic bottle is provided that has a sidewall having an exterior surface that defines a plane curve. The sidewall is joined with a base and an upper portion with a mouth to define an interior volume. The mouth has a set of threads to engage a cap for selectable closure. A handle is integrally formed in the sidewall that defines an aperture in the bottle. A set of lateral ribs on the handle enhance gripping. The bottle includes a set of identifying design elements that include at least one of one or more waves, delineating lines, and a shape of the bottle. One or more indicia in the form of decals may be applied to identify the product in the bottle by name, and to provide usage and safety information.

17 Claims, 4 Drawing Sheets

(56) References Cited

U.S. PATENT DOCUMENTS

| | | | | |
|---|---|---|---|---|
| 6,494,344 | B1 * | 12/2002 | Kressel, Sr. | B67D 7/04 222/481.5 |
| 10,829,277 | B2 * | 11/2020 | Olarte | B65D 25/20 |
| 10,934,066 | B1 * | 3/2021 | Kelley | B65D 25/2894 |
| 2002/0096486 | A1 * | 7/2002 | Bourque | B65D 1/0284 215/381 |
| 2002/0162821 | A1 | 11/2002 | Saito et al. | |
| 2004/0164048 | A1 * | 8/2004 | Yourist | B65D 1/0223 215/396 |
| 2006/0249477 | A1 * | 11/2006 | Simpson, Jr. | B65D 1/0284 215/373 |
| 2008/0047925 | A1 * | 2/2008 | Desico | B65D 1/0223 215/398 |
| 2011/0049086 | A1 * | 3/2011 | Boiros | B65D 79/0084 215/384 |
| 2012/0222976 | A1 * | 9/2012 | Cave | B65D 1/18 206/219 |
| 2012/0267381 | A1 * | 10/2012 | Trude | B29C 49/22 220/675 |
| 2012/0318767 | A1 * | 12/2012 | Burgess | B65D 23/10 215/40 |
| 2013/0001234 | A1 * | 1/2013 | Glover | B65D 1/40 220/604 |
| 2017/0369204 | A1 * | 12/2017 | Bermingham | B65D 25/42 |
| 2019/0002152 | A1 * | 1/2019 | Chivrac | B65D 23/102 |
| 2020/0339334 | A1 | 10/2020 | Bickford | |
| 2021/0214114 | A1 * | 7/2021 | Zimmer | B65D 1/0223 |

* cited by examiner

BOTTLE WITH INTEGRATED HANDLE AND DESIGN ELEMENT

RELATED APPLICATION DATA

This application claims priority U.S. Provisional Application No. 63/285,126, filed Dec. 2, 2022, the entire disclosure of which is hereby incorporated by reference as if set forth fully herein.

FIELD OF THE INVENTION

The present invention in general relates to a bottle, and in particular to a plastic bottle with a handle having a set of lateral ribs to enhance gripping, and accent elements integrally formed into an exterior surface of the bottle.

BACKGROUND OF THE INVENTION

Bottles are a popular product packaging container for liquid products. They can securely store and also efficiently dispense a liquid product contained therein. Bottles also offer flexibility in packaging shape and design. They are easily tailored to meet specific storage and dispense parameters of a given product, and also to meet brand recognition and advertising design parameters. While there are many benefits to the use of a bottle as a product packaging container, there are also disadvantages. For example, from a retail sales perspective, popularity of the bottle as a product packaging container presents a problem as to how to differentiate bottle-packaged product for a consumer amongst numerous similarly bottle-packaged product alternatives, especially in a retail store context where a product sits on a shelf in a store surrounded by numerous similarly bottle-packaged products.

In the field of vehicle maintenance products, a consumer generally has a variety of retail options for each specific vehicle maintenance product illustratively including windshield wiper fluid, exterior body waxes and polishes, tire cleaners, and interior cleaning solutions. A consumer can become easily overwhelmed and experience decision fatigue when attempting to choose from the numerous available options for the same vehicle maintenance product. This decision fatigue can be experienced both during online shopping and when shopping in a physical retail store. In fact, decision fatigue can be exacerbated when a consumer is shopping in a physical retail store. A consumer standing in front of a shelf with the numerous available product options arranged next to each other may find it difficult to discern the slight (or nonexistent) variations between the different brands and may start to feel overwhelmed. Decision fatigue produces negative consequences for both the seller of the product and the consumer. Often, a consumer experiencing decision fatigue will simply randomly select a vehicle maintenance product off the shelf in order to terminate the discomfort of decision fatigue. In this scenario, if the seller indeed is selling a superior product relative to other available alternative, the consumer is negatively affected because the consumer would benefit from purchase and use of the superior product. The seller is negatively affected because the reflexive random choice made by the consumer contributes to lost profit for the retailer.

One solution to this problem is through resort to a uniquely designed bottle that establishes brand recognition and differentiates it from other available alternatives, allowing consumers to easily recognize the product on a shelf in a retail store and also amongst on array of product images in the context of online shopping. Through marketing and consumer experience (i.e., when a consumer has already experienced instances of decision fatigue induced random choice, and based on prior use of a specific product, forms a conclusive opinion as to the superiority of the specific product relative to available alternatives), a unique bottle packaging design establishes brand recognition and brand loyalty, and allows a product to stand out from "the pack", making it easier for a consumer to remember positive instances of previous product use, and making it easier for a consumer to quickly locate the product when presented with a variety of product alternatives. This helps to mitigate consumer decision fatigue and encourage consumers to purchase the uniquely designed bottle, helping sellers to capture further profit that may otherwise be lost when a conventionally designed bottle is used for product packaging.

In addition to the brand recognition problem described above, bottles present another problem from a utility perspective. A typical bottle has a smooth exterior that makes gripping difficult, especially when a lubricious content is spilled on the bottle exterior. This negatively affects the seller, as a consumer experiencing product loss as a result of poor grip develops a negative association with the product. As many vehicle maintenance products are oily in nature and regularly handled in the context of vehicle maintenance, the grip concerns and the likelihood of an unpleasant spill cleanup are considerable. In addition to the grip concerns, larger bottles that are full of a product are often heavy and require a handle for the user pick up and hold the bottle.

There are many prior art solutions directed toward bottle grip, handling improvements, and unique design. However, these solutions remain lacking. In general, prior art solutions fail to achieve a desired nexus between both grip enhancement, product handling, and product differentiation where the grip and handling enhancements themselves also provide the beneficial product differentiation. Additionally, many prior art solutions are directed toward enhancing grip via bottle shape or via application of additional gripping facets onto an already produced bottle, and are thus lacking in an enhanced grip solution that can be adopted regardless of bottle shape.

Thus, there exists a need for a bottle with an enhanced grip and handling solution integral with the bottle regardless of bottle shape that also contributes to brand recognition and differentiates a product contained within bottle from other alternative product options.

SUMMARY OF THE INVENTION

A thermoplastic bottle is provided that has a set of sidewalls connected by a front side and a rear side, the side walls, front side, and rear side having an exterior surface. The sidewalls are joined with a base and an upper area to define an interior volume. The upper area has a selectively sealable mouth, and an integral handle is formed in the rear side, the integral handle forming an aperture in the bottle.

A method is provided for applying an after-market vehicle maintenance substance. The method includes removing a cap from the selectively sealable mouth of the bottle described above, gripping the integrated handle, and pouring a content from the volume of the bottle.

BRIEF DESCRIPTION OF THE DRAWINGS

The subject matter that is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

DETAILED DESCRIPTION OF THE INVENTION

Figure 1:
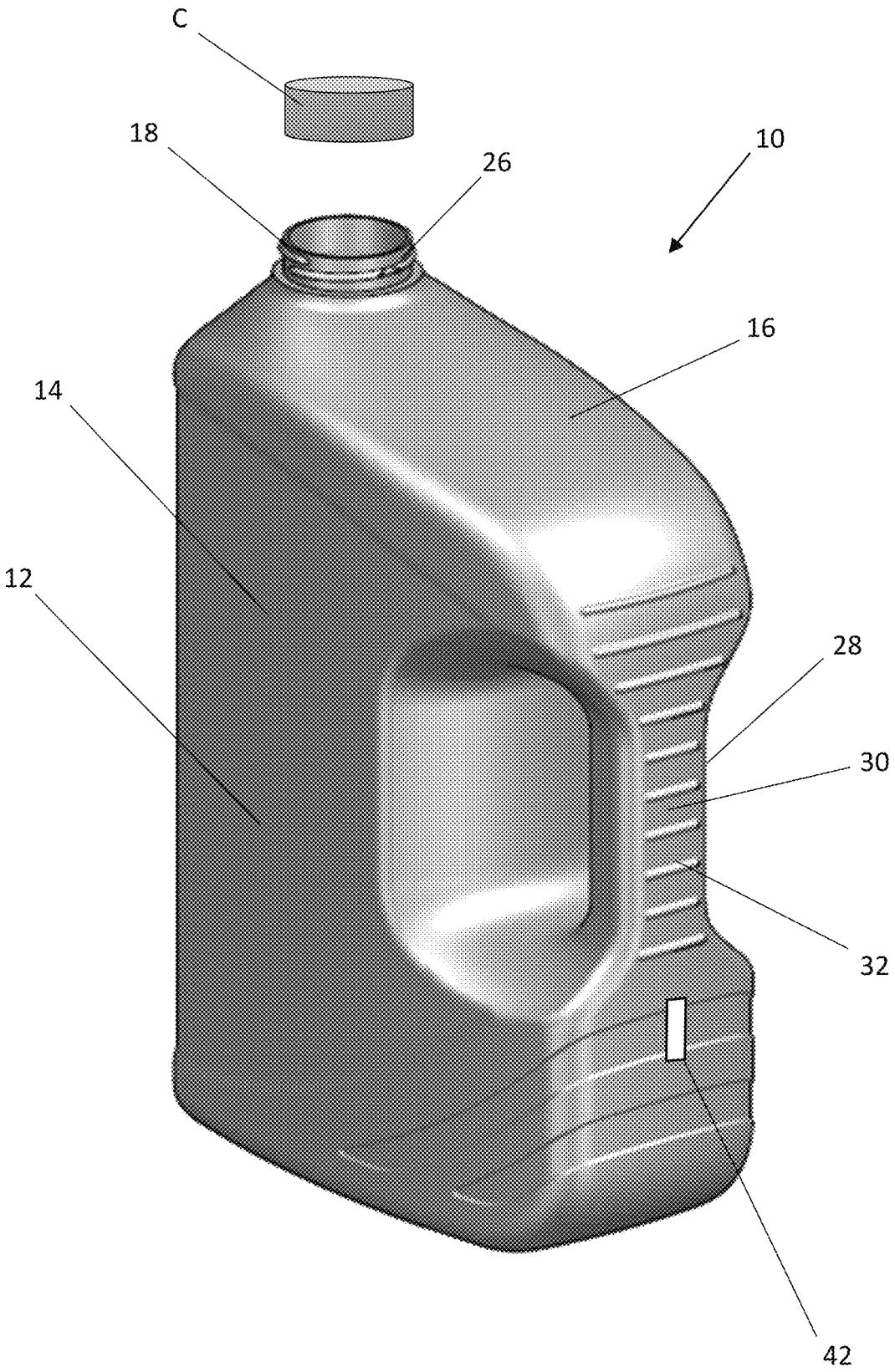
FIG. 1 is a perspective view of an inventive bottle with an integrated handle, enhanced ribbing for gripping, and distinctive identifying design elements formed into an exterior surface of the bottle.

The present invention has utility as a bottle with a handle, enhanced ribbing for gripping, and distinctive identifying design elements. An inventive bottle with features integral to the bottle sidewall and simultaneously recessed and protruding from a plane cure of the sidewall is uniquely identifiable relative to conventional bottles while enhancing the ability for a user to apply a fast grip thereto. Resort to the inventive ribbing creates a greater surface area that creates recesses in which drippage tends to pool thereby rendering the bottle easier to grip with the integral handle. The inventive ribbing and identifying design elements are also noted to increase surface area of the inventive bottle with limited profile deviations from the sidewall center that promotes high throughput injection molding of inventive bottles. In certain embodiments, the discrete waves, ribs, and integrated handle provide a bottle shape that is brand-identifiable while promoting firm grip of the inventive bottle by a user. The distinctive identifying design elements including the aforementioned wave and rib patterns are designed proportionally to the size of the bottle, so as to be visually appealing from the shelf and to provide unique bottle feature, finish texture, and comfortable grip. The integrated handle allows for larger bottle sizes including those over 3 liters (100 ounces).

In this disclosure, "comprises," "comprising," "containing" and "having" and the like can have the meaning ascribed to them in U.S. Patent law and can mean "includes," "including," and the like; "consisting essentially of" or "consists essentially" likewise has the meaning ascribed in U.S. Patent law and the term is open-ended, allowing for the presence of more than that which is recited so long as basic or novel characteristics of that which is recited is not changed by the presence of more than that which is recited, but excludes prior art embodiments.

It is to be understood that in instances where a range of values are provided that the range is intended to encompass not only the end point values of the range but also intermediate values of the range as explicitly being included within the range and varying by the last significant figure of the range. By way of example, a recited range from 1 to 4 is intended to include 1-2, 1-3, 2-4, 3-4, and 1-4. Furthermore, ranges provided herein are understood to be shorthand for all of the values within the range. For example, a range of 1 to 50 is understood to include any number, combination of numbers, or sub-range from the group consisting of 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, or 50, as well as all intervening decimal values between the aforementioned integers such as, for example, 1.1, 1.2, 1.3, 1.4, 1.5, 1.6, 1.7, 1.8, and 1.9 being between 1 and 2. With respect to sub-ranges, "nested sub-ranges" that extend from either end point of the range are specifically contemplated. For example, a nested sub-range of an exemplary range of 1 to 50 may comprise 1 to 10, 1 to 20, 1 to 30, and 1 to 40 in one direction, or 50 to 40, 50 to 30, 50 to 20, and 50 to 10 in the other direction.

Unless specifically stated or obvious from context, as used herein, the term "or" is understood to be inclusive. Unless specifically stated or obvious from context, as used herein, the terms "and" "the" are understood to be singular or plural.

Also, as used herein, "and/or" refers to and encompasses any and all possible combinations of one or more of the associated listed items, as well as the lack of combinations when interpreted in the alternative ("or").

As used herein, a "unit cell" is defined as the smallest repeating unit that can cover a plane curve of a bottle surface through only the operation of translation of the unit cell.

The suffix "(s)" as used herein is intended to include both the singular and the plural of the term that it modifies, thereby including one or more of that term.

Reference throughout the specification to "one embodiment," "another embodiment," "an embodiment," and so forth, when present, means that a particular element (e.g., feature, structure, and/or characteristic) described in connection with the embodiment is included in at least one embodiment described herein, and may or may not be present in other embodiments. In addition, it is to be understood that the described facets may be combined in any suitable.

In this disclosure, "comprises," "comprising," "containing" and "having" and the like can have the meaning ascribed to them in U.S. Patent law and can mean "includes," "including," and the like; "consisting essentially of" or "consists essentially" likewise has the meaning ascribed in U.S. Patent law and the term is open-ended, allowing for the presence of more than that which is recited so long as basic or novel characteristics of that which is recited is not changed by the presence of more than that which is recited, but excludes prior art embodiments.

It is to be understood that in instances where a range of values are provided that the range is intended to encompass not only the end point values of the range but also intermediate values of the range as explicitly being included within the range and varying by the last significant figure of the range. Furthermore, ranges provided herein are understood to be shorthand for all of the values within the range. For example, a range of 1 to 50 is understood to include any number, combination of numbers, or sub-range from the group consisting of 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, or 50, as well as all intervening decimal values between the aforementioned integers such as, for example, 1.1, 1.2, 1.3, 1.4, 1.5, 1.6, 1.7, 1.8, and 1.9. With respect to sub-ranges, "nested sub-ranges" that extend from either end point of the range are specifically contemplated. For example, a nested sub-range of an exemplary range of 1 to 50 may comprise 1 to 10, 1 to 20, 1 to 30, and 1 to 40 in one direction, or 50 to 40, 50 to 30, 50 to 20, and 50 to 10 in the other direction.

Unless specifically stated or obvious from context, as used herein, the term "or" is understood to be inclusive. Unless specifically stated or obvious from context, as used herein, the terms "a" "an." and the are understood to be singular or plural.

Also, as used herein, "and/or" refers to and encompasses any and all possible combinations of one or more of the associated listed items, as well as the lack of combinations when interpreted in the alternative ("or").

The suffix "(s)" as used herein is intended to include both the singular and the plural of the term that it modifies, thereby including one or more of that term.

Reference throughout the specification to "one embodiment", "another embodiment", "an embodiment", and so forth, when present, means that a particular element (e.g., feature, structure, and/or characteristic) described in connection with the embodiment is included in at least one embodiment described herein, and may or may not be present in other embodiments.

According the present invention, a bottle is readily formed to be transparent, translucent, or opaque; and is formed from a thermoplastic material. Thermoplastic materials operative herein illustratively include high density polyethylene (HDPE), acrylic or polymethyl methacrylate (PMMA), polycarbonate (PC), polyethylene (PE), polypropylene (PP), polyethylene terephthalate (PET), polyvinyl chloride (PVC), acrylonitrile-butadiene-styrene (ABS), and graft copolymers containing at least 50% by mass of at least one of the recited thermoplastics. In certain embodiments, the thermoplastic material has a flexural modulus of between 0.1 and 10.0 GPa imparting further enhanced grip to the inventive bottle.

An inventive bottle is formed through injection blow molding, extrusion blow molding, one-step injection molding, two-step injection molding, stretch blow molding, or a multi-layer co-extrusion.

A bottle or other article formed according to the present invention has an exterior surface decorated with ribs that enhance the ability of a user to grip the integral handle of the bottle, even if slick with drippage, while imparting a unique trade dress to the bottle. It is appreciated that thermoplastic bottle formation varies relative to glass molding as to the viscosity of the molten material.

The present invention will now be described with reference to the following embodiments. As is apparent by these descriptions, this invention can be embodied in different forms and should not be construed as limited to the embodiments set forth herein. Rather, these embodiments are provided so that this disclosure will be thorough and complete, and will fully convey the scope of the invention to those skilled in the art. For example, features illustrated with respect to one embodiment can be incorporated into other embodiments, and features illustrated with respect to a particular embodiment may be deleted from the embodiment. In addition, numerous variations and additions to the embodiments suggested herein will be apparent to those skilled in the art in light of the instant disclosure, which do not depart from the instant invention. Hence, the following specification is intended to illustrate some particular embodiments of the invention, and not to exhaustively specify all permutations, combinations, and variations thereof.

Figure 2:
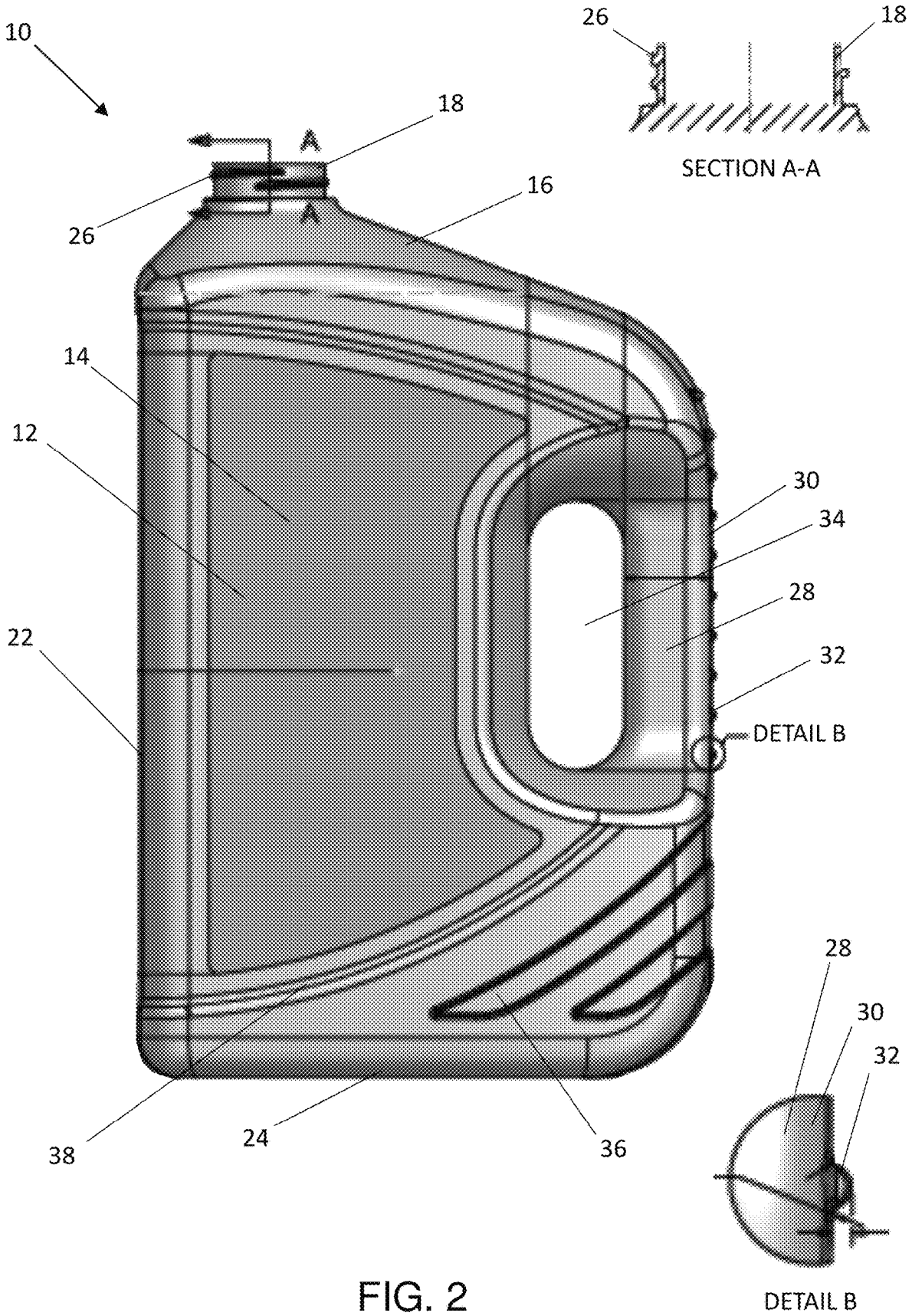
FIG. 2 is a side view of the bottle of FIG. 1 showing the full extent of the integrated handle, with detail A-A showing a cross-sectional view of the selectively sealable mouth with screw-on threads, and detail B showing the ribbing on the outer surface of the handle.

Referring now to the figures, FIG. 1 is a perspective view of an inventive bottle shown generally at 10 and FIG. 2 is side view thereof. The bottle 10 has smooth sidewalls 12 having an exterior surface 14 and terminating in an upper area 16 and a selectively sealable mouth 18. It is appreciated that the shape and depicted details of the bottle 10 are merely exemplary and that the elements are readily formed in any article shape amenable to molding by one of the aforementioned techniques. The sidewalls 12 may have a slight curvature 20 as best shown in the top and bottom views of the bottle 10 in FIGS. 3B and 3C, respectively. The bottle 10 has a base 24. The upper area 16, the base 24, and the sidewall 12 are integrally formed and define an interior volume V. The selectively sealable mouth 18 has threads 26 as best shown in cross-sectional detail A-A of FIG. 2. A cap C with mating threads may be screwed on to the threads 26 to seal the container 10.

The smooth sidewalls 12 may have one or more indicia in the form of decals applied to identify the product by name, and to provide usage and safety information. In a specific embodiment a single decal may wrap around the smooth front face 22 to cover both sidewalls 12. It is appreciated that the surfaces 14 of the sidewalls 12 are amenable to receiving or displaying brand-identifying indicia illustratively including an adhesive label, an insignia, a logo, and the like. It is further appreciated that in certain inventive embodiments, the brand-identifying indicia is be affixed to the sidewalls 12, while in other inventive embodiments the brand-identifying indicia is integrally formed in the surfaces 14 during or after the molding of bottle 10. It is still further appreciated that in some inventive embodiments, the brand-identifying indicia is integrally formed with the surfaces 14 by embossing or debossing.

Figure 3A:
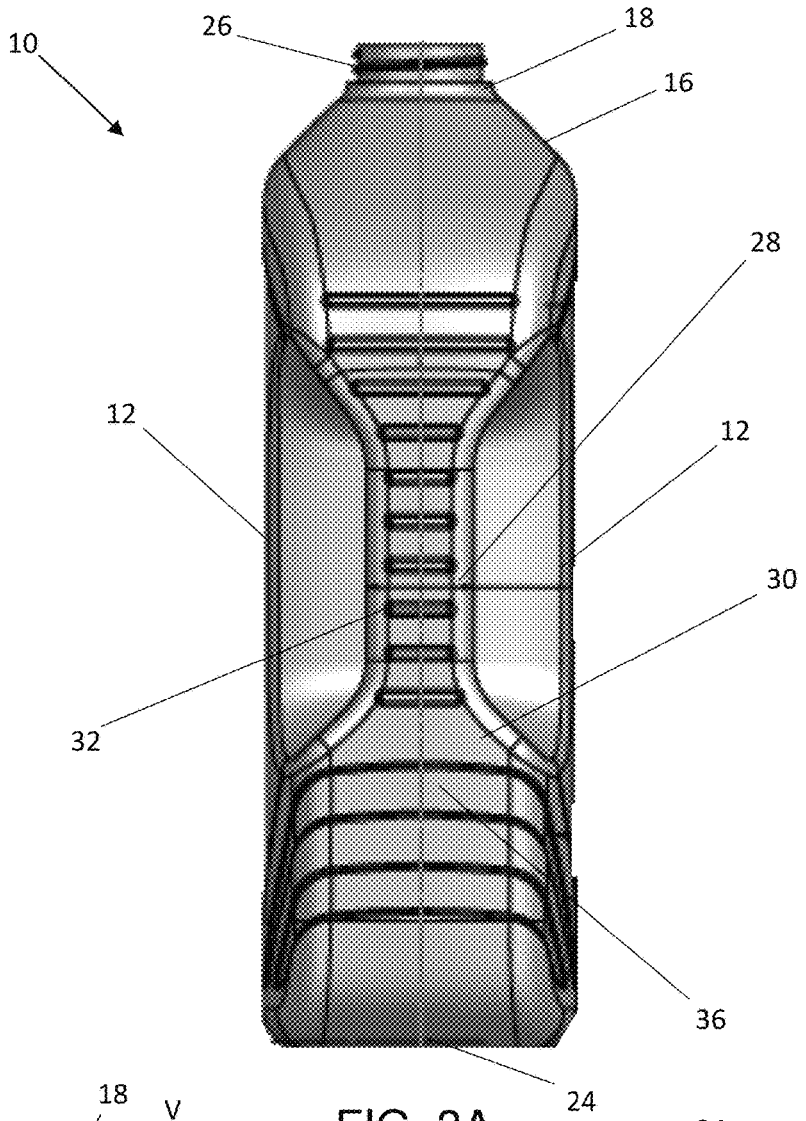
FIG. 3A is a back view of the bottle of FIG. 1 showing the ribbing on the outer surface of the handle and the wrap around portions of the distinctive identifying design elements in accordance with embodiments of the invention.
Figure 3B:
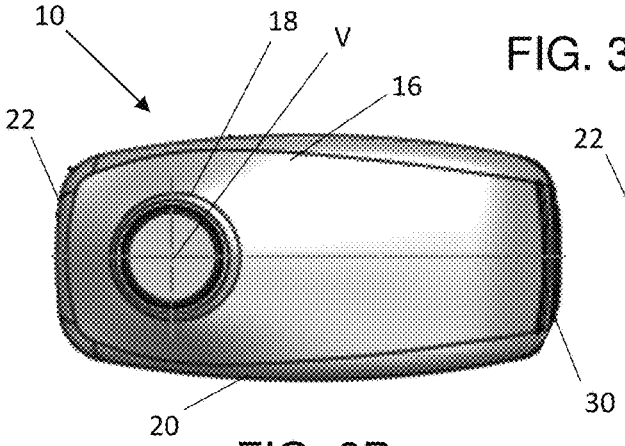
FIG. 3B is a top view of the bottle of FIG. 1 showing the selectively sealable mouth in accordance with an embodiment of the invention.
Figure 3C:
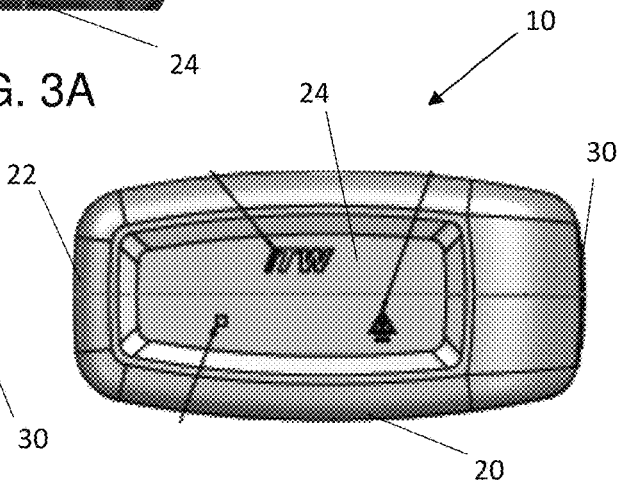
FIG. 3C is a bottom view of the bottle of FIG. 1 in accordance with embodiments of the invention.

An integral handle 28 may be formed on the rear side 30 of the bottle 10. A series of lateral ribs 32 are formed along the portion of the rear side 30 that coincides with the handle 28 as best shown in FIGS. 1, 2, and 3A. The series of lateral ribs 32 along the rear side 30 form a ladder pattern that assists in gripping the bottle 10. The lateral ribs 32 illustratively have a cross-sectional shape that includes semicircular, oval, triangular, square, and rectilinear. The typical height of rib 32 protruding from the rear side 30 is from 0.5 to 3 mm with a basal width of from 0.5 to 3 mm. The integral handle 28 defines an aperture 34 in the body of the bottle 10, where the aperture 34 is large enough for a user's fingers to be inserted when gripping the bottle 10. Owing to the flexural properties of a bottle 10 formed from thermoplastic, grip pressure on the rear surface 30 of the bottle 10 along the handle 28 outfitted with lateral ribs 32 compresses the lateral ribs 32 and causes localized concentric deformation about the lateral ribs 32 that further increases the contact area between the user hand and the bottle 10. In operation, the bottle 10 retains a low center of gravity as contents are pouring through the mouth 18 and the inner volume of the integral handle 28 is emptied.

Inventive embodiments of the bottle 10 may include distinctive identifying design elements including one or more waves 36 and delineating lines 38 that are molded into the surface of the bottle 10 and provide a three-dimensional texture and look to the bottle 10. The distinctive identifying design elements (36, 38) provide a visual cue to consumers looking for the branded product. In some inventive embodiments, the plastic of the design elements 36, 38, or both are either translucent or transparent to provide a user with a visual window 42 to observe the remaining contents of the bottle 10. The typical dimensions of a wave 36 include a width from 5 to 20 mm with a wave depth of from 0.5 to 2 mm. In still other inventive embodiments, the delineating line 38 is within 30 degrees of being orthogonal to the meniscus of contents in the bottle when the contents are limited and being poured therefrom. By way of example, when the bottle is approximately half full of contents, the meniscus intersects a delineating line 38 near the base of the integral handle 28 and as more content is poured out via the mouth 18, the meniscus angle approaches parallel to, and near the smooth front face 22.

Figure 4A:
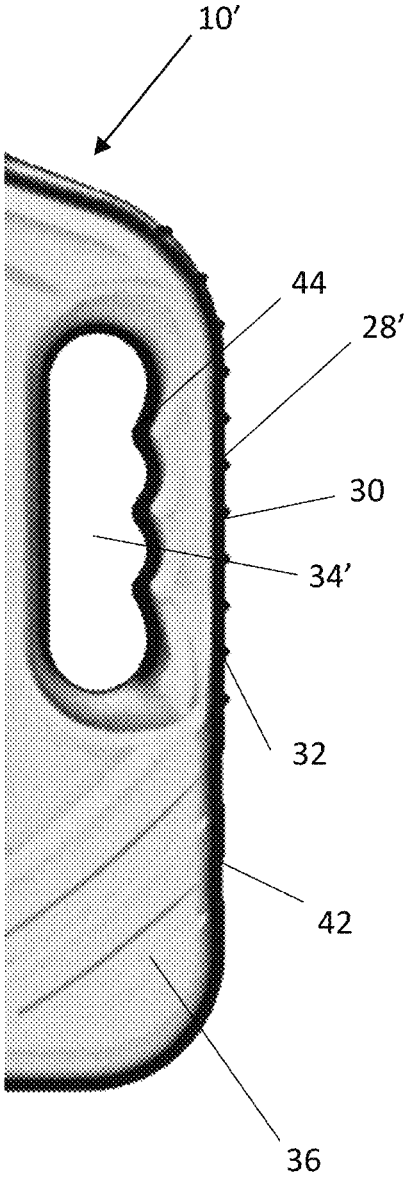
FIG. 4A is a partial side view of an alternate embodiment of the bottle inclusive of finger grips.
Figure 4B:
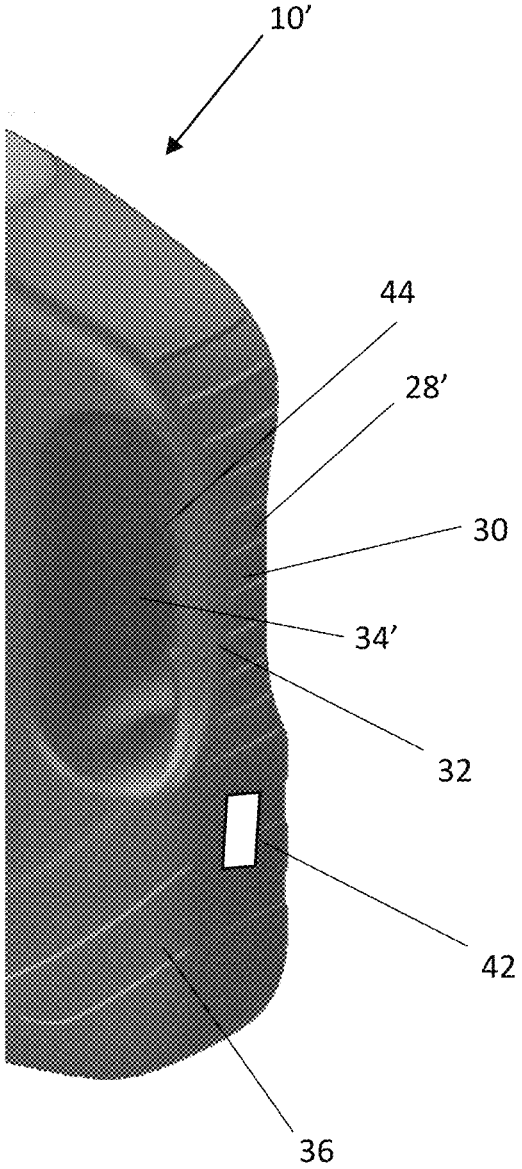
FIG. 4B is a perspective view of the bottle portion of FIG. 4A.

As shown with respect to FIGS. 4A and 4B, where like reference numerals have the meaning previously ascribed thereto and portions not shown therein are identical to those shown with respect to FIGS. 1-3B, an integral handle 28' may be formed on the rear side 30 of the bottle 10'. A series of lateral ribs 32 are formed along the portion of the rear side 30 that coincides with the handle 28'. The integral handle 28' defines an aperture 34' large enough for a user's fingers and includes ergonomic grip features 44.

An inventive bottle is used in the application of an after-market vehicle maintenance substance in the form of a liquid or flowable powder and a referred to generically content of an inventive bottle. Typically, such fluids contain surfactants or are lipophilic resulting in any surface coated with such a fluid becoming slippery when dripped. After allowing the drippage to seep into recesses of the ribbing in the handle area, gripping the bottle is improved relative to a conventional bottle.

While particular embodiments have been described, alternatives, modifications, variations, improvements, and substantial equivalents that are or may be presently unforeseen may arise to applicants or others skilled in the art. Accordingly, the appended claims as filed and as they may be amended, are intended to embrace all such alternatives, modifications variations, improvements, and substantial equivalents. It should also be appreciated that the exemplary embodiment or exemplary embodiments are only examples, and are not intended to limit the scope, applicability, or configuration of the described embodiments in any way. Rather, the foregoing detailed description will provide those skilled in the art with a convenient roadmap for implementing the exemplary embodiment or exemplary embodiments. It should be understood that various changes may be made in the function and arrangement of facets without departing from the scope as set forth in the appended claims and the legal equivalents thereof.

Patent documents and publications mentioned in the specification are indicative of the levels of those skilled in the art to which the invention pertains. These documents and publications are incorporated herein by reference to the same extent as if each individual document or publication was specifically and individually incorporated herein by reference.

The invention claimed is:

1. A thermoplastic bottle comprising:

a set of sidewalls connected by a front side and a rear side, said side walls, front side, and rear side having an exterior surface;

said sidewalls joined with a base and an upper area to define an interior volume, said upper area having a selectively sealable mouth;

an integral handle formed in said rear side, said integral handle having a width extending from a first side of the handle to a second side of the handle, said integral handle forming an aperture in said bottle;

a series of lateral ribs protruding from the rear side in a direction away from the interior volume in a portion of the rear side that coincides with said handle, the lateral ribs being continuous across the width of said handle, the lateral ribs configured to enhance a grip on the bottle when the series of lateral ribs are contacted by a palm of a user; and an identifying design element formed in the set of side walls and in either the front side or in the rear side and below the lateral ribs, the identifying design element being transparent or translucent, and the identifying design element forming a visual window to observe the contents of the bottle.

2. The bottle of claim 1 wherein each of said series of lateral ribs independently has a height of from 0.5 to 3 mm and a basal width of from 0.5 to 3 mm.

3. The bottle of claim 1 wherein said identifying design element is at least one of: at least one wave, at least one delineating line, or a combination thereof.

4. The bottle of claim 3 wherein said at identifying design element is molded into the exterior surface.

5. The bottle of claim 3 wherein said at least one wave is present and has a wave width from 5 to 20 mm and a wave depth of from 0.5 to 2 mm.

6. The bottle of claim 1 further comprising one or more indicia in the form of decals applied to identify the product by name, and to provide usage and safety information.

7. The bottle of claim 6 wherein said one or more indicia is a single decal that wraps around the front face and covers the set of sidewalls.

8. The bottle of claim 1 wherein a brand-identifying indicia is integrally formed in the exterior surface during or after molding of the bottle.

9. The bottle of claim 1 wherein a brand-identifying indicia is integrally formed in the exterior surface by embossing or debossing.

10. The bottle of claim 1 wherein the bottle is clear, transparent, translucent, or opaque.

11. The bottle of claim 1 wherein the thermoplastic comprises one of high density polyethylene (HDPE), acrylic or polymethyl methacrylate (PMMA), polycarbonate (PC), polyethylene (PE), polypropylene (PP), polyethylene terephthalate (PET), polyvinyl chloride (PVC), acrylonitrile-butadiene-styrene (ABS), or graft copolymers containing at least 50% by mass of at least one of the recited thermoplastics.

12. The bottle of claim 1 wherein the thermoplastic material has a flexural modulus of between 0.1 and 10.0 GPa.

13. The bottle of claim 1 wherein said set of sidewalls have a curvature.

14. The bottle of claim 1 further comprising ergonomic grip features in the aperture.

15. The bottle of claim 1 further comprising an after-market vehicle maintenance fluid in said interior volume.

16. A method of applying an after-market vehicle maintenance substance comprising:

removing a cap from said selectively sealable mouth of the bottle of claim 1;

gripping the integral handle; and pouring a content of the substance from the volume of the bottle.

17. The method of claim 16 further comprising viewing a meniscus associated with the content through a wave or delineating line of the bottle during the pouring.

* * * * *